US007964823B2

(12) United States Patent
Armstrong et al.

(10) Patent No.: US 7,964,823 B2
(45) Date of Patent: Jun. 21, 2011

(54) WALL OVEN AND CORRESPONDING METHOD

(75) Inventors: James Armstrong, Louisville, KY (US); Michael David Gallant, Ooltewah, TN (US); William Henry Gross, Erie, PA (US); William L. Holbrook, Goshen, KY (US); William Byron Wiggins, Marietta, GA (US)

(73) Assignee: General Electric Company, Schenectady, NY (US)

( * ) Notice: Subject to any disclaimer, the term of this patent is extended or adjusted under 35 U.S.C. 154(b) by 679 days.

(21) Appl. No.: 11/928,514

(22) Filed: Oct. 30, 2007

(65) Prior Publication Data

US 2009/0107479 A1 Apr. 30, 2009

(51) Int. Cl.
*A21B 1/22* (2006.01)
*F24C 15/32* (2006.01)

(52) U.S. Cl. ..... 219/400; 219/391; 126/21 A; 126/198; 126/287; 99/474

(58) Field of Classification Search ..... 219/400, 219/391; 126/21 A, 198, 287; 99/474
See application file for complete search history.

(56) References Cited

U.S. PATENT DOCUMENTS

| | | | | |
|---|---|---|---|---|
| 4,618,756 | A | 10/1986 | Schwaderer et al. | |
| 4,812,617 | A | 3/1989 | Takeuji et al. | |
| 7,049,568 | B2 | 5/2006 | Jeong | |
| 2006/0237425 | A1 * | 10/2006 | Kim et al. | 219/400 |

* cited by examiner

*Primary Examiner* — Shawntina Fuqua
(74) *Attorney, Agent, or Firm* — Global Patent Operation; Douglas D. Zhang

(57) ABSTRACT

In an embodiment, a wall oven has a cooking cavity surrounded by a baffled cavity. The wall oven has a door for restricting access to the cooking cavity. A control cavity has a front surface maintaining controls for operation of the wall oven. An exhaust fan is in flow communication with the control cavity and the baffled cavity for directing air from the control cavity and the baffled cavity into an exhaust cavity. An air divider separates the control cavity from the exhaust cavity. A method for cooling a control panel of a wall oven is also disclosed.

16 Claims, 3 Drawing Sheets

WALL OVEN AND CORRESPONDING METHOD

BACKGROUND OF THE INVENTION

This invention relates generally to an appliance, and more particularly, to a built in wall oven.

A wall oven may be one or more oven units separated from a cook top surface or stove unit. It may also include a microwave or speed-cooking appliance. The built in oven is often in a cavity surrounded by a cabinet or has wall surfaces in close proximity to the oven external surfaces. Further, there is generally poor airflow and often an inability to remove heated air from above and around the built in wall oven.

Generally, the wall oven utilizes an electric or gas heating element. Some wall ovens known as a self-cleaning wall oven have a self-clean cycle. During the self-clean cycle the interior temperatures of the oven may reach more then 425° C. Thus the exterior surfaces can become very hot which in turn can cause wood or other construction materials surrounding the built in wall oven to become heated, potentially to the point of combustion. It has therefore become the industry practice to include a forced air ventilation system around the wall oven to exhaust the heated air in the cavity.

Various forced air-ventilating systems for self-cleaning wall ovens have been developed. Particularly, ventilating systems for self-cleaning ovens in which a forced air fan is not provided have been developed. In such an arrangement the passages around the oven are arranged to obtain sufficient air movement by convection. Obviously when the inner walls of the oven reach high temperature levels, the heat tends to radiate or be convected or conducted to outer walls, thereby raising the outer walls to undesirably high and possibly unsafe temperature levels. Attempts have been made to overcome this problem by supplying additional baffling to prevent some of the internally generated heat from contacting the outer wall structure. This reduces the volume of the cooking cavity of the oven and reduces consumer satisfaction.

With increasingly stringent surface temperature limits being imposed upon range and installed oven manufacturers, in some installations it is questionable whether the convection ventilating systems will meet the requirements. As to those arrangements which include forced air fans, the airflow paths are not considered to be optimized to obtain the most advantageous results, and in some of the arrangements dampers are provided, which while inexpensive, in some instances will block convection flow if a failure of the exhaust fan occurs.

Recently the market has seen a proliferation of programmable cooking controls or computerized cooking controls in appliances. These controls may include LCD screens, microswitches and touchpanel displays. These devices contain semi-conductor chips, integrated circuits, photodiode displays and the like, which are designed to operate within a limited range of environmental temperature, and may become destroyed, degraded or inoperative if subjected to too high a temperature for too long a length of time. Often, such electronic controls are not manufactured by the manufacturer of the oven but purchased as a standard item from an outside supplier. These standard or "off the shelf" components often have a temperature limit of approximately 105° C.

To reduce the temperature that these components are subjected to, oven manufactures have traditionally used down draft or reverse flow cooling. In these types of cooling flow patterns, air is drawn into the oven at the controls. This causes the air around the controls to be at or near the ambient temperature of the room. However, to complete the cooling of the oven, the air drawn in at the controls is then forced by a fan down along the sides of the oven and out the base. This causes the fan to be of larger capacity than necessary as it must counter the natural tendency for the hot air in the oven baffles to rise.

SUMMARY OF THE INVENTION

As described herein, embodiments of the invention overcome one or more of the above or other disadvantages known in the art.

In an embodiment, a wall oven has a cooking cavity surrounded by a baffled cavity. The wall oven has a door for restricting access to the cooking cavity. A control cavity has a front surface maintaining controls for operation of the wall oven. An exhaust fan is in flow communication with the control cavity and the baffled cavity for directing air from the control cavity and the baffled cavity into an exhaust cavity. An air divider separates the control cavity from the exhaust cavity.

In an alternate embodiment, provided is a method of cooling a control panel of a wall oven in a wall oven cavity. The method comprises separating the control panel cavity from the exhaust cavity with an air divider that has at least one wall, drawing ambient air into the control cavity through the control panel, combining the air in the control cavity with at least heated air from a baffled cavity, using a fan to exhaust the combined air into an exhaust cavity, and exhausting the air in the exhaust cavity out the front of the oven above the door.

These and other embodiments of the invention are further described in the detailed description of the invention and should not be considered limiting in scope.

BRIEF DESCRIPTION OF THE SEVERAL VIEWS OF THE DRAWINGS

The following figures illustrate examples of embodiments of the invention. The figures are described in detail below.

DESCRIPTION OF THE PREFERRED EMBODIMENT

Embodiments of the invention are described below, with reference to the figures. Throughout the figures, like reference numbers indicate the same or similar components. References to preferred embodiments are for illustration and understanding, and should not be taken as limiting.

Figure 1:
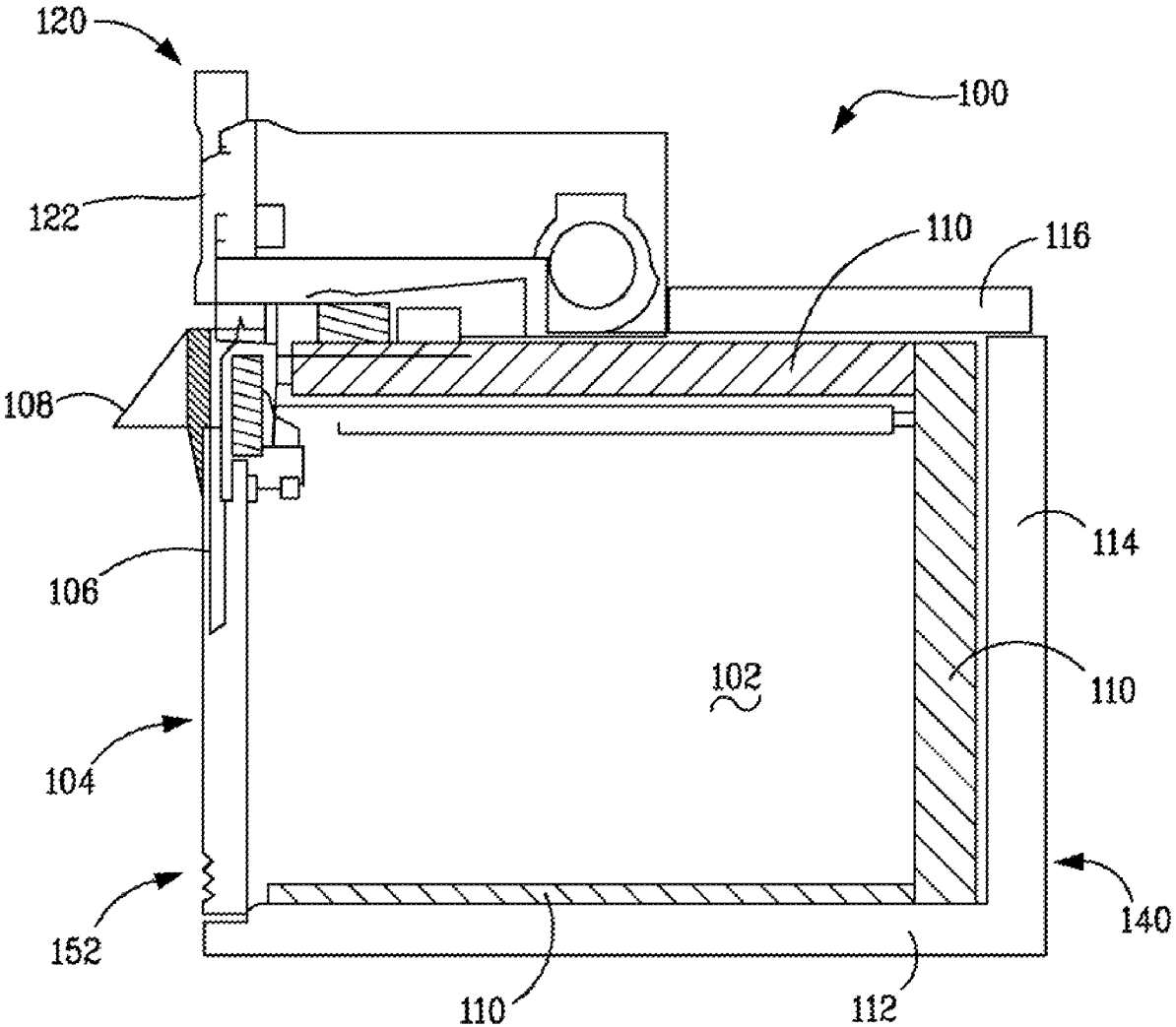
FIG. 1 is a general side view of a self-cleaning wall oven incorporating the invention.
Figure 2:
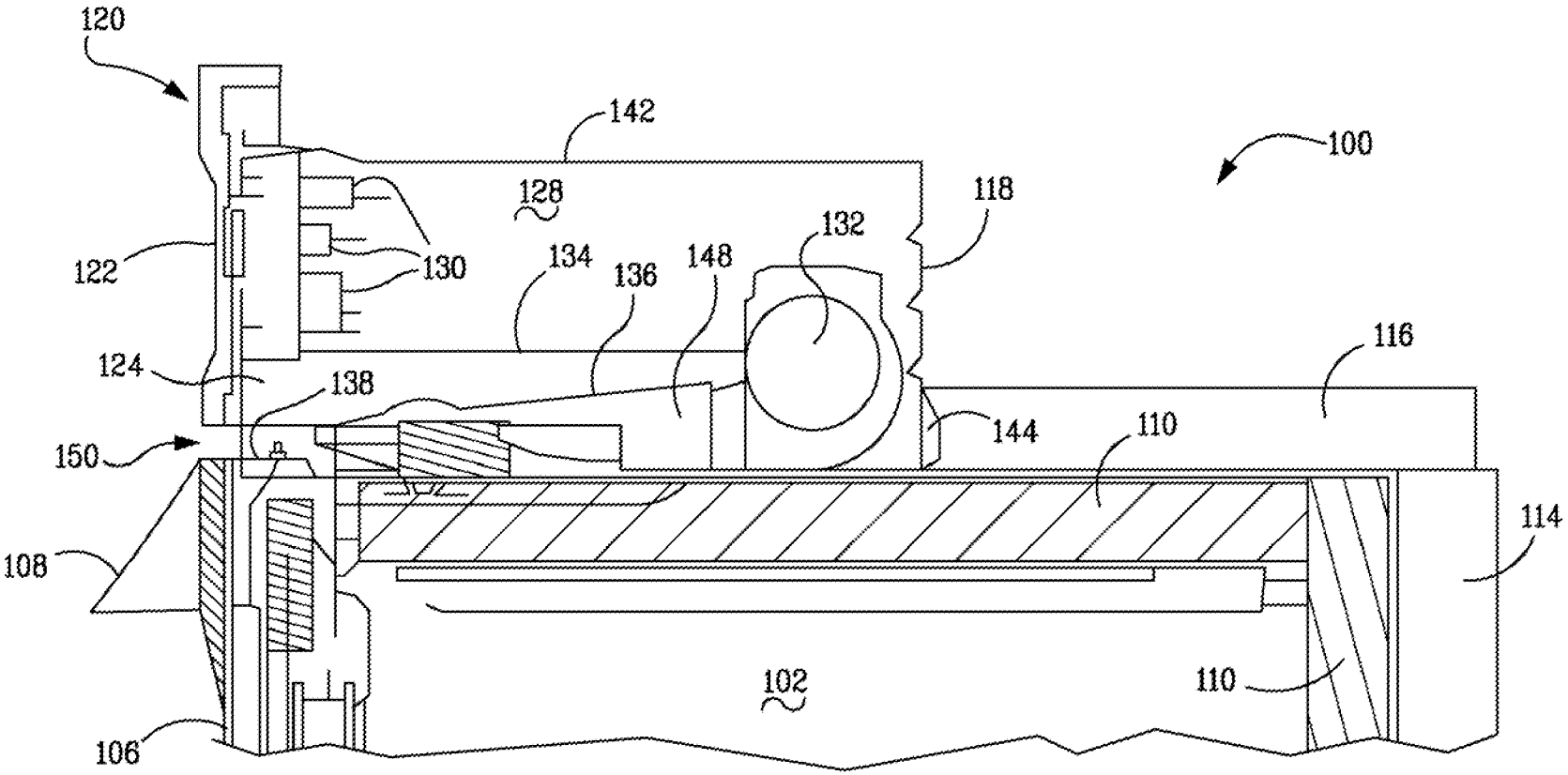
FIG. 2 is a partial side view of the self-cleaning wall oven of FIG. 1.
Figure 3:
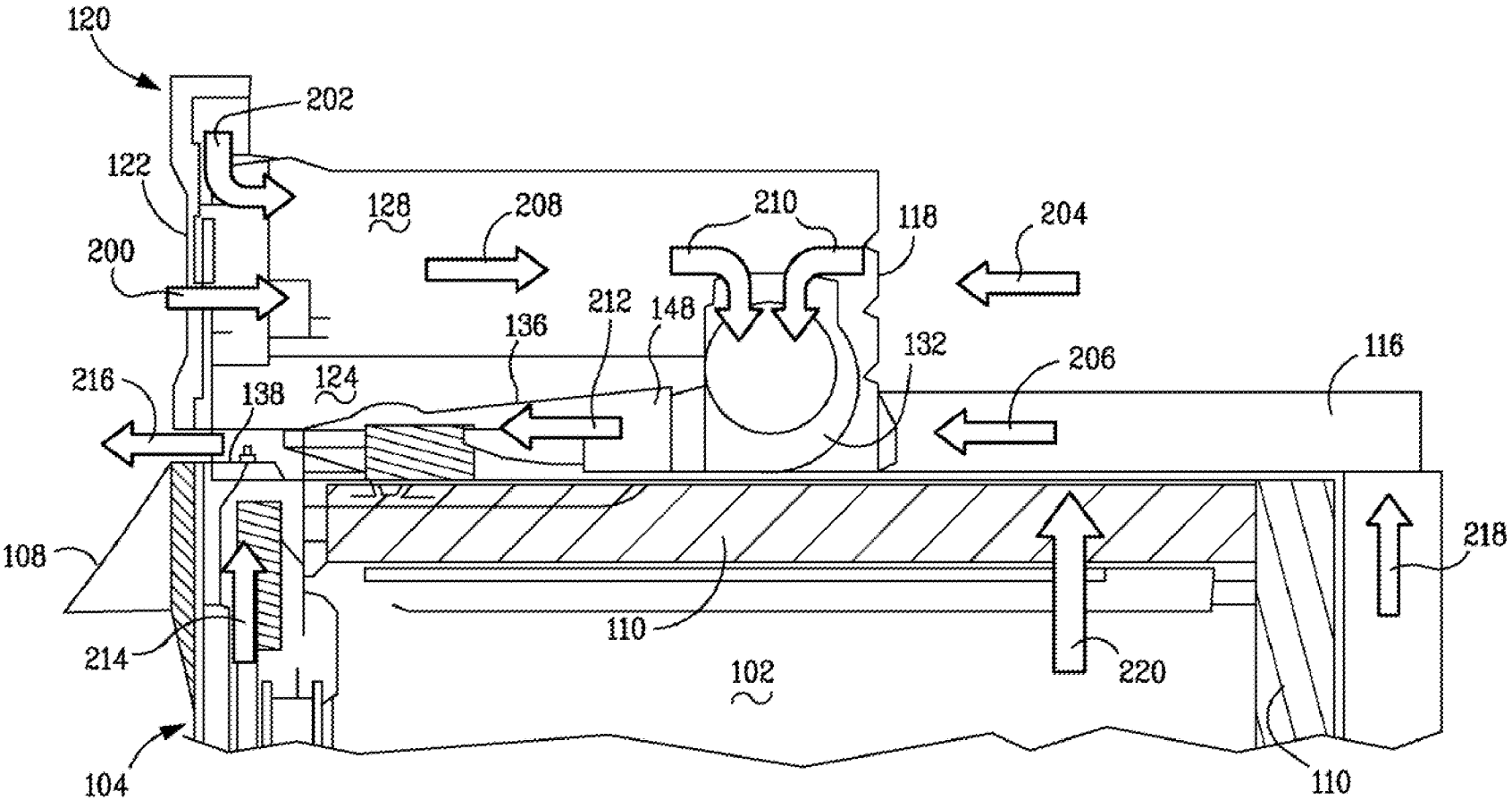
FIG. 3 is a partial side view of the oven of the self-cleaning wall oven of FIG. 1 indicating airflow patterns.

Referring to the FIGS. 1-3, an oven 100 has oven cavity 102 is generally defined by box-shaped oven liner and insulation 110. Cavity 102 is provided with an opening in the front and has a door 104 for limiting access. Door 104 may have a window 106 for observation of items being cooked without opening door 104. Further, door 104 has handle 108 to facilitate opening and closing.

Oven 100 has a control panel 120 providing user controls 122 for setting the operating temperature and time for a cooking cycle. Other controls and devices may be included, such as but not limited to, timers, clocks, LED readouts, LCD or other displays, gauges, or other controls.

An outer shell 140 for the oven assembly as a whole and insulation 110 define baffled cavities 112, 114 and 116. Lower baffled cavity 112 is generally open and allows air to flow in any direction. Back baffled cavity 114, has defined channels allowing air to flow from lower baffled cavity 112 to upper baffled cavity 116.

As shown in FIG. 2 a chamber characterized as the control cavity 128 is formed in the top of oven 100 and is bounded at the top by top wall 142, at the rear by vent 118, at the sides by the opposite side walls (not shown), and at the front by the control panel 120. The bottom of the control cavity 128 is bounded by the control cavity bottom wall 134. The control panel 120 houses the operating controls 122 operable from the front and connected to operating elements 130 such as switches, timers and oven controls supported immediately behind the control panel assembly. The operating controls 122 must be kept below a maximum temperature due to environmental operating parameters of the controls, preferably 105° C.

During operation air is drawn through controls 122 from the ambient air into cavity 128, as well as, through vent 118 from the area surrounding the back of the oven and through vent 144 from baffled cavity 116 by fan 132. Vent 144 allows the heated air accumulating in baffled cavity 116 to be moved out of the oven 100. The heated air in baffled cavity 116 is accumulated from baffled cavities 112, 114 and side cavities (not shown), as the heated air rises.

The control chamber bottom wall 134 defines a top wall of an air divider. While a single wall may be used as an air divider, insert 136 defines a bottom wall for cavity 124 and creates an air divider with an air cavity. Wall 134 and insert 136 are provided to prevent airflow between cavities 124, 128, 148. Thus, cavity 124 isolates control cavity 128 from the heat in exhaust cavity 148. Wall 134 and insert 136 may be made out of sheet metal or any suitable material that will not degrade under the temperatures experienced during use.

The heated air in exhaust cavity 148 is exhausted to the surrounding environment at 150. As the air exits exhaust cavity 148 it passes over vents 138 in the top of door 106. This creates a venturi effect and draws air from the interior of the door. The air inside the door is replaced with ambient air through vents 152 at the base of the door. Thus, the surface temperature of the door is kept to a minimum.

FIG. 3 depicts the flow pattern of the air around and in the oven during operation of the invention. Generally, air 220 and 218 around the oven cooking cavity 102 is heated during operation of the oven; this causes the air to rise to baffled cavity 116. During operation of the oven fan 132 is activated which draws air 210 from cavity 128 and heated air 206 from baffled cavity 116. The air 208 is a combination of ambient air 200 drawn though the controls and warm air 202 drawn from above the oven. Air 208 and warm air 218 drawn from behind the oven are combined in cavity 128 to form air 210. The fan combines the heated air 206 with the much cooler air 210 and pushes the combined air 212 into exhaust cavity 148. As air 212 is exhausted from the oven 100 it passes over venturi 138 drawing warm air 214 out of door 104. The combined air 214 and 212 are exhausted above the handle 108 of door 104 as exhaust air 216. Exhaust air 216 is warmer then the ambient air 200 but cooler then heated air 206. Cavity 124 experiences no appreciable air flow.

This written description uses examples to disclose embodiments of the invention, including the best mode, and to enable a person of ordinary skill in the art to make and use embodiments of the invention. It is understood that the patentable scope of embodiments of the invention is defined by the claims, and can include additional components occurring to those skilled in the art. Such other components and examples are understood to be within the scope of the claims.

What is claimed is:

1. A wall oven comprising:

a cooking cavity;

a door for restricting access to the cooking cavity;

a baffled cavity partially surrounding the cooking cavity;

a control cavity defined in part by a control panel, the control panel comprising controls for operation of the wall oven;

an exhaust cavity disposed between the cooking cavity and the control cavity;

an exhaust fan in flow communication with at least the control cavity and the baffled cavity for drawing air from the control cavity and the baffled cavity into the exhaust cavity; and an air divider defining a cavity between the control cavity and the exhaust cavity so that the control cavity is spaced apart from the exhaust cavity.

2. The wall oven of claim 1, wherein the air divider comprises two spaced walls.

3. The wall oven of claim 1, wherein the door comprises a top surface, an inner space having an outlet terminating at the top surface and an inlet, the exhaust cavity having an exit disposed between the control panel and the top surface of the door so that air expelled from the exhaust cavity passes the outlet and creates a venturi effect to draw air from the inner space of the door.

4. The wall oven of claim 1, wherein the baffled cavity comprises cavities that surround bottom, sides, back and top of the cooking cavity, respectively.

5. The wall oven of claim 1, wherein the control cavity is defined in part by a back wall with at least one vent, and the exhaust fan is in flow communication with ambient air through the at least one vent.

6. The wall oven of claim 2, wherein the two spaced walls comprise a bottom wall of the control cavity and an insert disposed between the bottom wall of the control cavity and the cooking cavity.

7. The wall oven of claim 2, wherein the two spaced walls are not parallel to each other.

8. A cooking appliance comprising:

a cooking cavity;

a door for restricting access to the cooking cavity;

a baffled cavity partially surrounding the cooking cavity;

a control cavity defined in part by a control panel, the control panel comprising at least one control for operation of the cooking appliance;

an exhaust cavity disposed between the cooking cavity and the control cavity;

an exhaust fan in flow communication with at least the control cavity and the baffled cavity for drawing air from the control cavity and the baffled cavity into the exhaust cavity; and an air divider defining a cavity between the control cavity and the exhaust cavity so that the control cavity is spaced apart from the exhaust cavity.

9. The cooking appliance of claim 8, wherein the air divider comprise two spaced walls.

10. The cooking appliance of claim 9, wherein the two spaced walls comprise a bottom wall of the control cavity and an insert disposed between the bottom wall of the control cavity and the cooking cavity.

11. The cooking appliance of claim 9, wherein the two spaced walls are not parallel to each other.

12. The cooking appliance of claim 8, wherein the door comprises a top surface, an inner space having an outlet terminating at the top surface and an inlet, the exhaust cavity having an exit disposed between the control panel and the top surface of the door so that air expelled from the exhaust cavity passes the outlet and creates a venturi effect to draw air from the inner space of the door.

13. The cooking appliance of claim 8, wherein the baffled cavity comprises cavities that surround bottom, sides, back and top of the cooking cavity, respectively.

14. The cooking appliance of claim 8, wherein the control cavity is defined in part by a back wall with at least one vent, and the exhaust fan is in flow communication with ambient air through the at least one vent.

15. The cooking appliance of claim 8, wherein the cooking appliance is an oven.

16. The cooking appliance of claim 8, wherein the cooking apparatus is a wall oven.

* * * * *